US008544912B1

(12) United States Patent
Matthews

(10) Patent No.: US 8,544,912 B1
(45) Date of Patent: Oct. 1, 2013

(54) LIFTING SLING ASSEMBLY

(75) Inventor: Clarence Michael Matthews, Gladewater, TX (US)

(73) Assignee: Ma-Tex Wire Rope Co., Inc., Kilgore, TX (US)

( * ) Notice: Subject to any disclaimer, the term of this patent is extended or adjusted under 35 U.S.C. 154(b) by 3 days.

(21) Appl. No.: 13/473,348

(22) Filed: May 16, 2012

(51) Int. Cl.
*B66C 1/12* (2006.01)

(52) U.S. Cl.
USPC ..... 294/74

(58) Field of Classification Search
USPC ..... 294/74, 82.11, 82.14; 24/265 AL, 24/165, 298, 302
See application file for complete search history.

(56) References Cited

U.S. PATENT DOCUMENTS

| | | | | |
|---|---|---|---|---|
| 2,561,487 | A * | 7/1951 | Bailhe | 114/230.26 |
| 3,058,184 | A * | 10/1962 | Ritzheimer | 24/115 R |
| 3,310,333 | A * | 3/1967 | Hutson | 294/82.11 |
| 4,317,257 | A * | 3/1982 | Engel | 452/128 |
| 4,529,240 | A * | 7/1985 | Engel | 294/141 |
| 7,536,754 | B2 * | 5/2009 | Campbell et al. | 24/265 R |
| 7,905,527 | B1 * | 3/2011 | Smallin | 294/66.1 |

* cited by examiner

*Primary Examiner* — Stephen Vu
(74) *Attorney, Agent, or Firm* — Eric C. Schmalbach

(57) ABSTRACT

A lifting sling assembly comprises a centering collar element forming a concentric sleeve around a central concavity, a centering housing element, a wire rope, and a lifting support. The centering housing element is defined by a concentric flange member forming a concentric sleeve around the centering housing element. The wire rope is inserted into the central concavity, and the centering collar element is swaged onto the wire rope. The centering collar element, the centering housing element, and the concentric flange member are integrated into a contiguous non-welded assembly such that the wire rope remains rigid within the centering collar member. The lifting support is a mechanical support lifting apparatus.

18 Claims, 12 Drawing Sheets

LIFTING SLING ASSEMBLY

BACKGROUND

BOPs (Blow out Preventers) and other drilling equipment used on land based wells must be removed and replaced in the process of performing services on the well. These devices are important to the safety of the well and are considered as critical safety assets. Service companies have used various types of lifting assemblies to remove and replace the equipment. Such assemblies are typically attached to an elevator and then connected to the equipment to be lifted. A problem exists in the security and efficiency of these lifting assembly connections between an elevator and the equipment.

Conventional lifting assemblies suffer from one or more deficiencies. For example, such assemblies may contain insecure connections to the elevator. Such insecure connections may result in damage to the equipment. The connections may often be easily removable, and may be removed or misplaced. Such lifting assemblies often employ non-standard assembly components, and are not properly tagged or marked. Therefore, a need exists for a contiguous lifting sling assembly which provides a secure and efficient method of lifting.

SUMMARY

Embodiments of the invention are directed towards solving the need for a lifting sling assembly which provides a secure and efficient method of lifting. Embodiments of the invention comprise a unique proprietary design of a lifting sling assembly which in turn connects to an elevator. The lifting sling assembly provides a secure connection to the elevator and may be implemented to fit differing dimensions of elevators. In an embodiment, the lifting assembly is a permanent, contiguous assembly with a centering housing element, a centering collar element, and a concentric flange member. Wire rope is inserted into a central concavity within the centering housing element, and the centering housing element is swaged onto the cable. A lifting means is attached to the wire rope. This assembly prevents components from being removed and misplaced. The lifting assembly may also be recertified with specification and working load limits.

BRIEF DESCRIPTION OF THE DRAWINGS

These and other features, aspects and advantages of embodiments of the invention will become better understood with regard to the following description, appended claims, and accompanying drawings where:

DESCRIPTION

Overview

Figure 1:
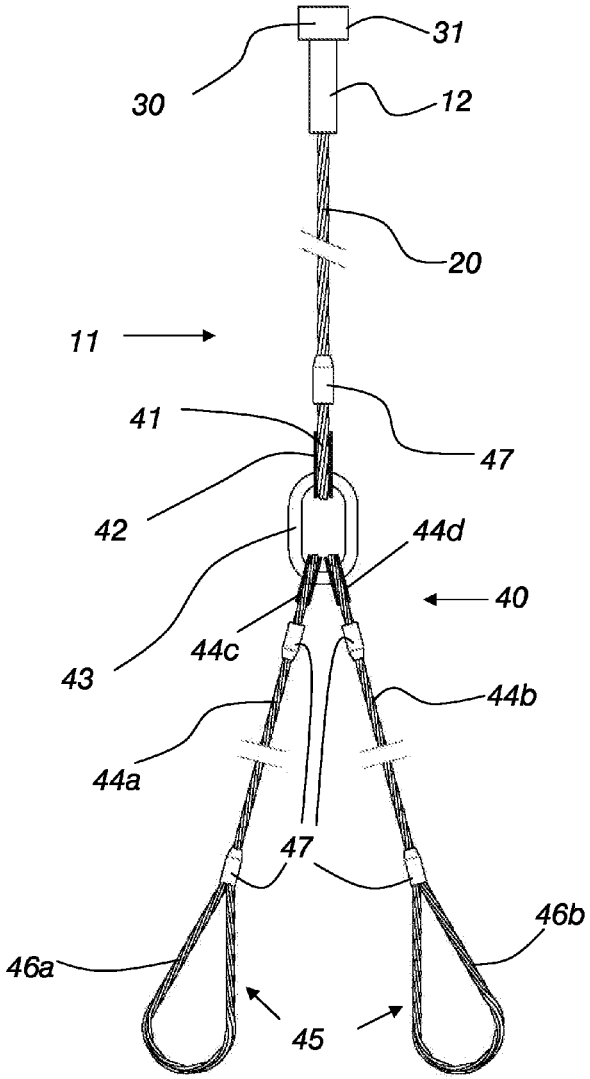
FIG. 1 is a front view of a lifting sling assembly according to an embodiment of the invention.

FIGS. 1-7 illustrate a lifting sling assembly according to a preferred embodiment of the invention. As shown in FIGS. 1-7, a lifting sling assembly 11 has a centering collar element 12, a wire rope 20, a centering housing element 30, and a lifting support means 40.

DETAILED DESCRIPTION OF A PREFERRED EMBODIMENT

Figure 4:
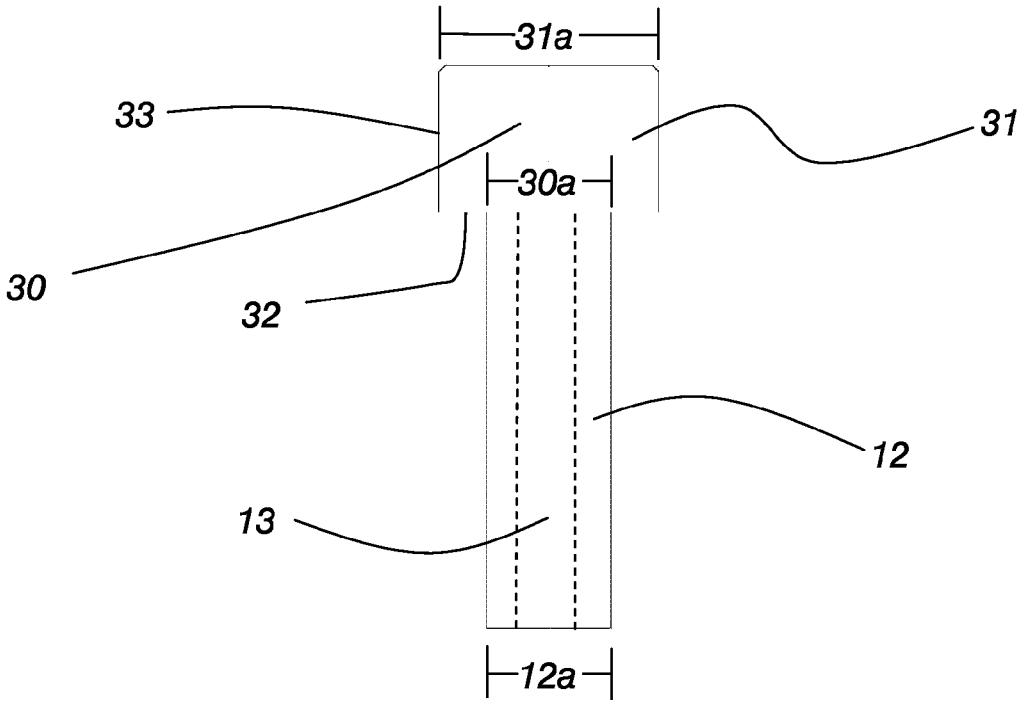
FIG. 4 is a cross-sectional front view of a centering collar element, centering housing element, and concentric flange member, according to the embodiment of FIG. 1.
Figure 5:
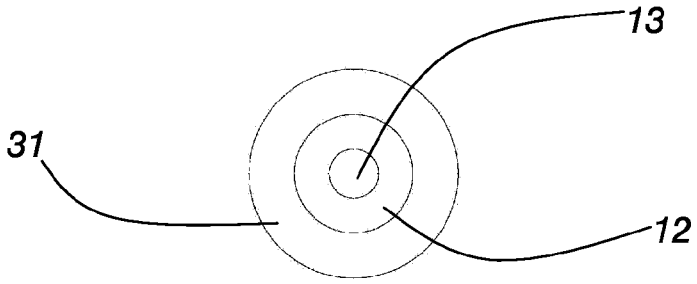
FIG. 5 is a cross-sectional bottom view of a centering collar element, centering housing element, and concentric flange member, according to the embodiment of FIG. 1.
Figure 6:
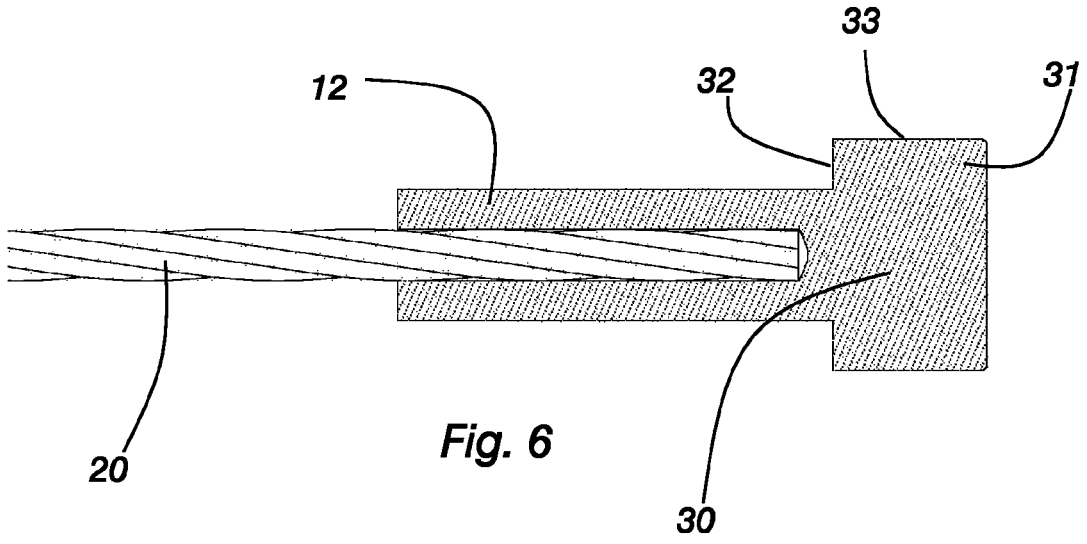
FIG. 6 is a cross-sectional front view of a centering collar element, centering housing element, and concentric flange member, and a wire rope, according to the embodiment of FIG. 1.
Figure 7:
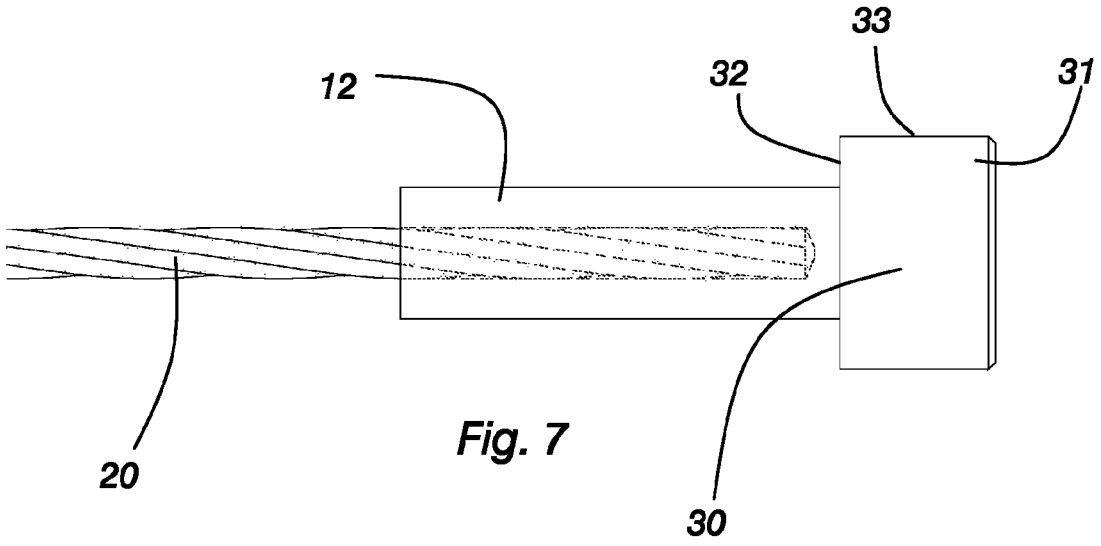
FIG. 7 is a partial cross-sectional front view of a centering collar element, centering housing element, and concentric flange member, and a wire rope, according to the embodiment of FIG. 1.

According to the preferred embodiment, a centering collar element 12 is a longitudinally extending rigid cylindrical member, with a central concavity 13. The centering collar element 12 is shaped such that if forms a concentric sleeve around the central concavity 13. The centering collar element outer diameter 12*a* is shown in FIG. 4. The centering collar element 12 is constructed such that the central concavity 13 can accommodate a wire one inch (1") to (2") in diameter.

A wire rope 20 is an elongate wire constructed of resilient tensile material. the wire rope 20 of the preferred embodiment is a type of rope implementing a plurality of strands of metal wire twisted into a helical pattern. The diameter of the wire rope 20 in the preferred embodiment is one inch (1") to two inches (2") in diameter (although other embodiments may use varying wire dimensions) of desired length.

A centering housing element 30 is a longitudinally extending rigid cylindrical member. A concentric flange member 31 is a concentric sleeve surrounding the centering housing element 30. As shown in FIGS. 3-7, the concentric flange member 31 has a lower flange surface 32, and side flange surface 33. The centering housing element outer diameter 30*a* (the diameter below the flanged portion) is approximately the same as the centering collar element outer diameter 12*a*, as shown in FIG. 4. The flange outer diameter 31*a* is greater than that of the centering housing element outer diameter 30*a* and the centering collar element outer diameter 12*a*, as shown in FIG. 4. The centering housing element 30, concentric flange member 31, and centering collar element 12 are machined as one continuous element. The shape and dimensions of the concentric flange member 31 may be adapted to fit existing tools. For example, in the preferred embodiment, the concentric flange member 31 may be adapted to fit both 2⅜" and 2⅞" elevators.

Figure 2:
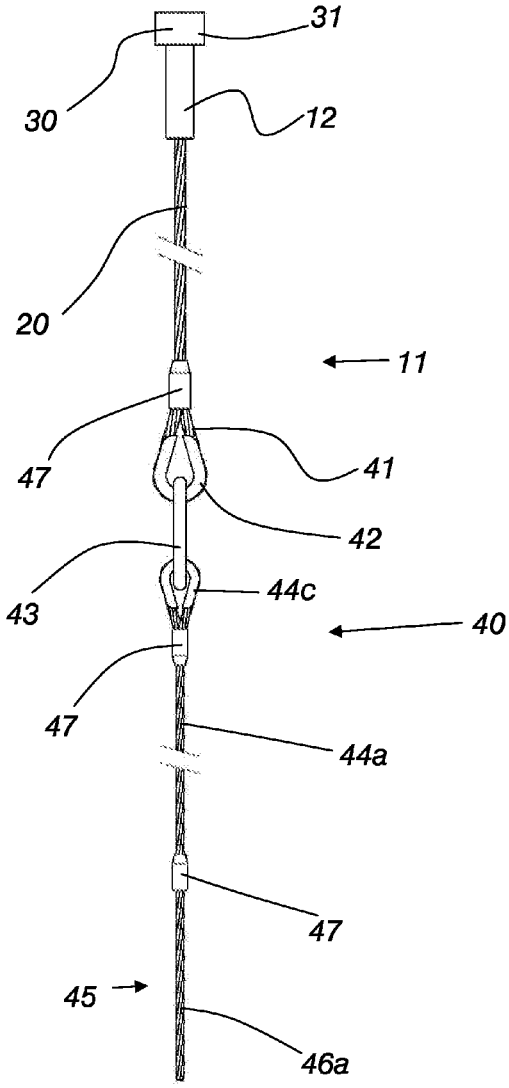
FIG. 2 is a side view of a lifting sling assembly according to the embodiment of FIG. 1.
Figure 3:
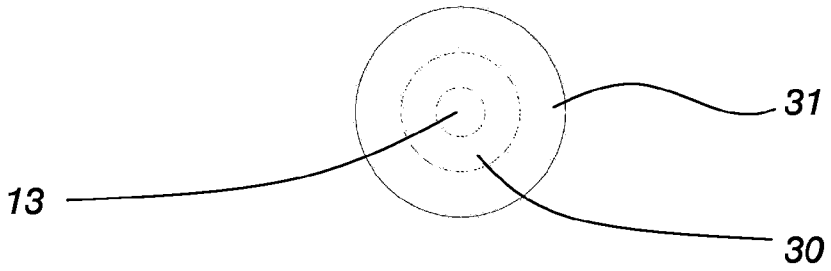
FIG. 3 is a cross-sectional top view of a centering collar element, centering housing element, and concentric flange member, according to the embodiment of FIG. 1.

A lifting support 40 is a mechanical support lifting apparatus. In the lifting support 40 of the preferred embodiment, the wire rope 20 has a wire rope termination 41. The wire rope termination 41 is a wire rope thimble eye 42 with a D-Ring 43 fabricated into the wire rope thimble eye 42, as shown in FIGS. 1-2. Two lifting wire rope legs 44*a*, 44*b*, of equal length are fabricated into the D-Ring 43 via wire rope leg thimble eyes 44*c*, 44*d*. The diameter of the wire rope legs 44*a*, 44*b*, may vary according to specific load parameters. The diameter of the wire rope legs 44*a*, 44*b* also determines the final working load limit of the assembly, with larger diameter ropes providing an increased working load limit. Lifting wire rope leg 44*a*, 44*b* diameters may range from ½" to ⅞" in the preferred embodiment. A lifting termination 45 forms the connection point for the intended load, as shown in FIGS. 1-2. According to the preferred embodiment, the lifting termination 45 implements two lifting eyes 46*a*, 46*b*, as shown in FIGS. 1-2. The lifting support 40 of the preferred embodiment may include one or more wire rope sleeves 47, as shown in FIGS. 1-2.

The wire rope 20 is inserted into the central concavity 13. The centering collar element 12 is swaged onto the wire rope 20. The swaging provides a permanent and continuous assembly of the wire rope 20, into the centering collar element 12. Accordingly, the wire rope 20, centering collar element 12, centering housing element 30, and concentric flange member 31 exist as one continuous element constructed of steel.

During operation, the lifting sling assembly 11 provides a means of lifting point loads such as BOPs and other drilling equipment. In the lifting of a BOP, an elevator mutually engages the outer periphery of the upper portion of the centering collar element 12. The lower flange surface 32 forms a load bearing surface, contacting the top of the elevator. A BOP or drilling equipment can be connected to the lifting termination 45. The elevator then may lift or descend the lifting sling assembly 11 and attached load.

Advantages of the Invention

Embodiments of the lifting sling assembly provide a secure and efficient method of lifting. The assembly of the wire rope 20, centering collar element 12, centering housing element 30, and concentric flange member 31 is a permanent, contiguous assembly. The individual components cannot be removed or misplaced. Such permanent assembly provides a secure and efficient connection of the equipment. Secure connections, contiguous assembly, and use of wire rope instead of abrasive material such as chain, minimizes the potential of damaging equipment in the process of lifting, removing, or replacing such equipment. Moreover, the assembly can be certified and tagged according to specifications and working load limits when fabricated, and may be recertified by the manufacturer periodically to insure integrity and safe use of assembly over time. Such uniform design may allow for a specified safety rating to be applied to such systems.

The upper portion of the centering housing element 30, and concentric flange member 31 are designed to fit existing hardware. For example, systems implementing the proprietary design may fit both 2⅜" and 2⅞" elevators. The lifting support means can be adapted to fit differing working load parameters, while still maintaining a uniform connection to the elevator. The uniform assembly allows inspection and recertification at periodic intervals, such as on an annual or more frequent basis. The recertification process is more efficient as no welds are used in the assembly. The connection has a higher efficiency rating, due to the integration of the individual elements. The entire assembly is designed to be a lightweight movable piece, such that can be easily operated and moved by one and two man crews.

Alternatives

Although the invention has been set forth in the previously described best mode, other alternative embodiments are possible. For example, the types of lifting terminations may vary according to desired load characteristics. The lifting terminations may include thimble eye/shackles, standard eyes, oversize eyes, or sliding choker hooks.

Figure 8:
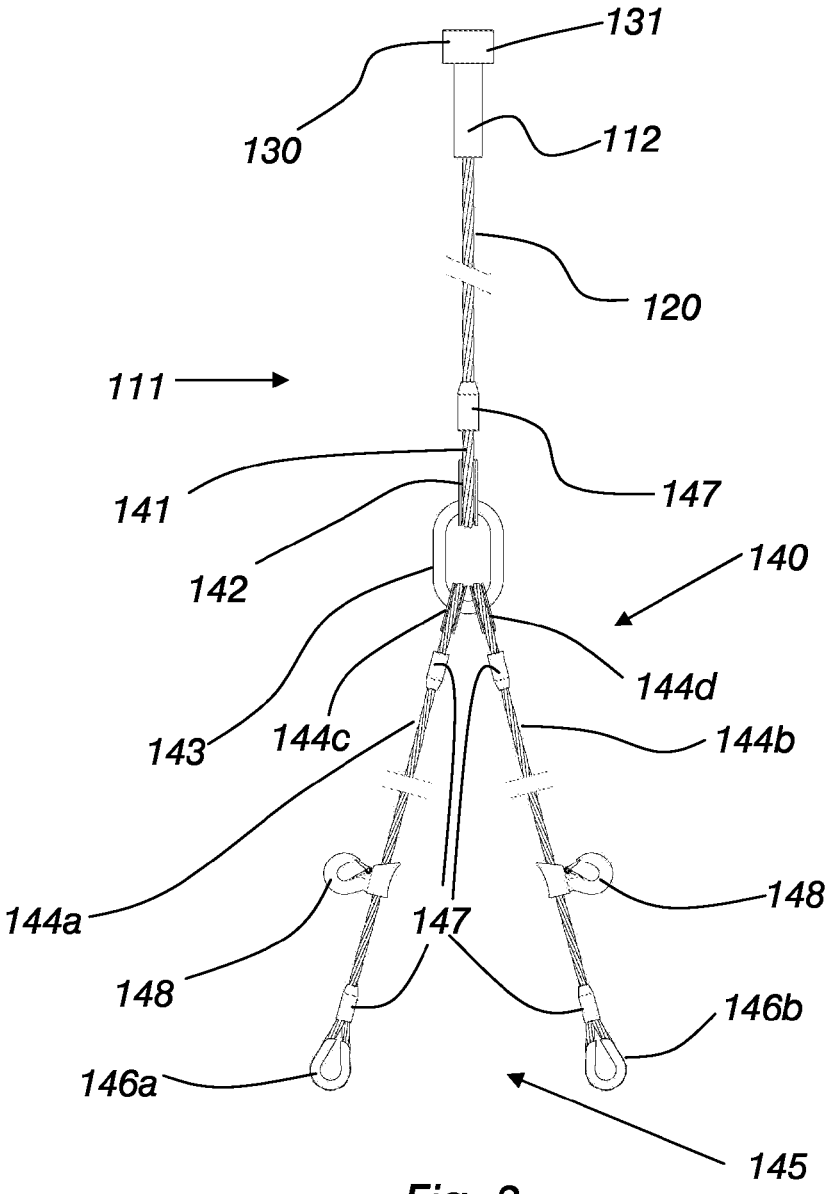
FIG. 8 is a front view of a lifting sling assembly according to a first alternate embodiment of the invention.
Figure 9:
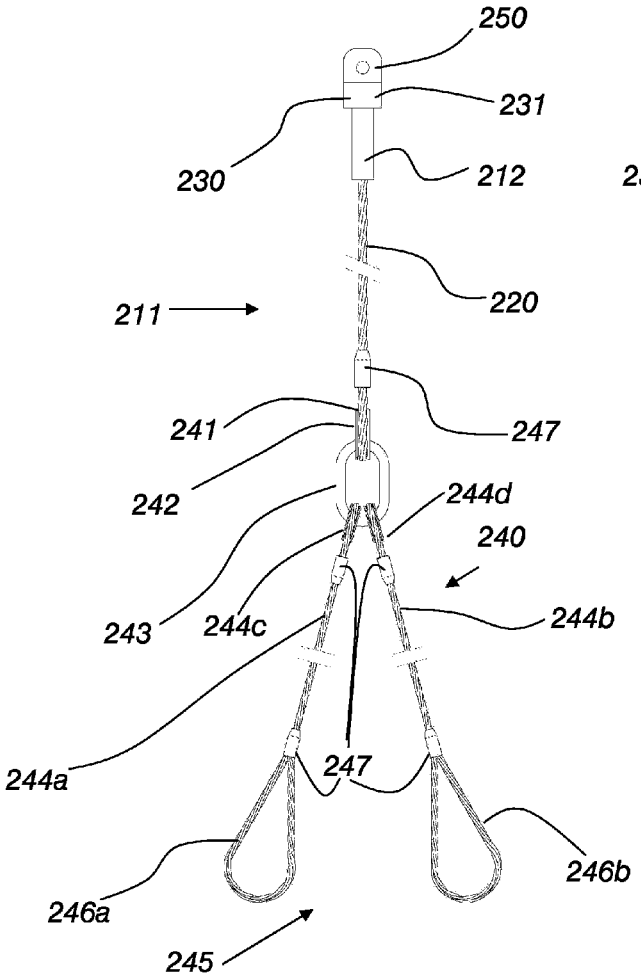
FIG. 9 is a front view of a lifting sling assembly according to a second alternate embodiment of the invention.
Figure 10:
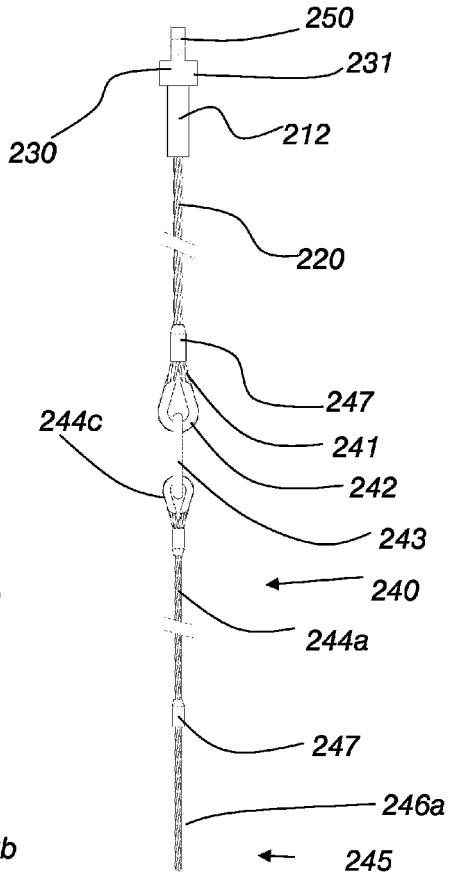
FIG. 10 is a side view of a lifting sling assembly according to the embodiment of FIG. 9.
Figure 11:
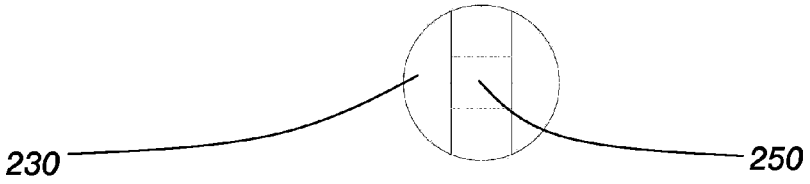
FIG. 11 is a cross-sectional top view of a centering collar element, centering housing element, concentric flange member, and lifting eye member, according to the embodiment of FIG. 9.
Figure 12:
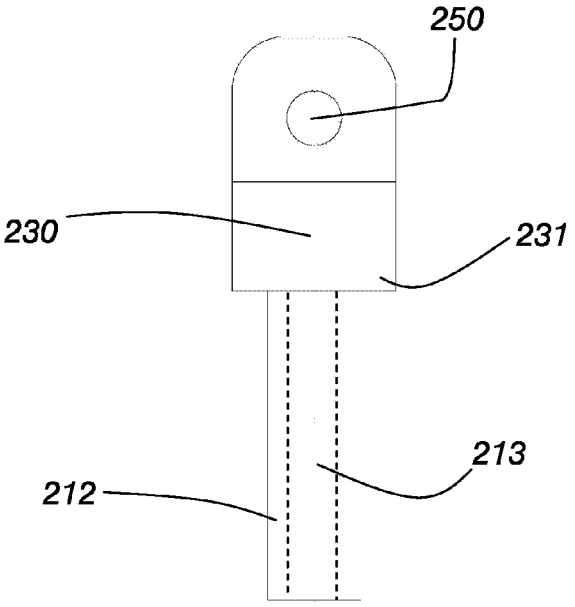
FIG. 12 is a cross-sectional front view of a centering collar element, centering housing element, concentric flange member, and lifting eye member, according to the embodiment of FIG. 9.
Figure 13:
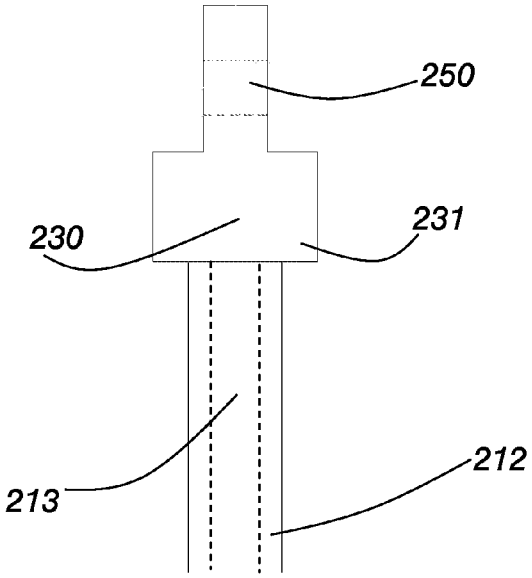
FIG. 13 is a cross-sectional side view of a centering collar element, centering housing element, concentric flange member, and lifting eye member, according to the embodiment of FIG. 9.
Figure 14:
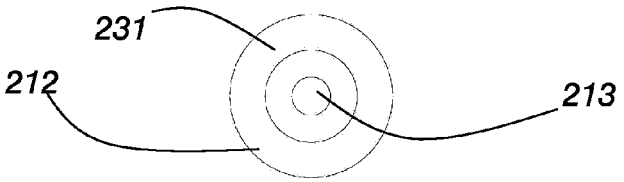
FIG. 14 is a cross-sectional bottom view of a centering collar element, centering housing element, concentric flange member, and lifting eye member. according to the embodiment of FIG. 9.
Figure 15:
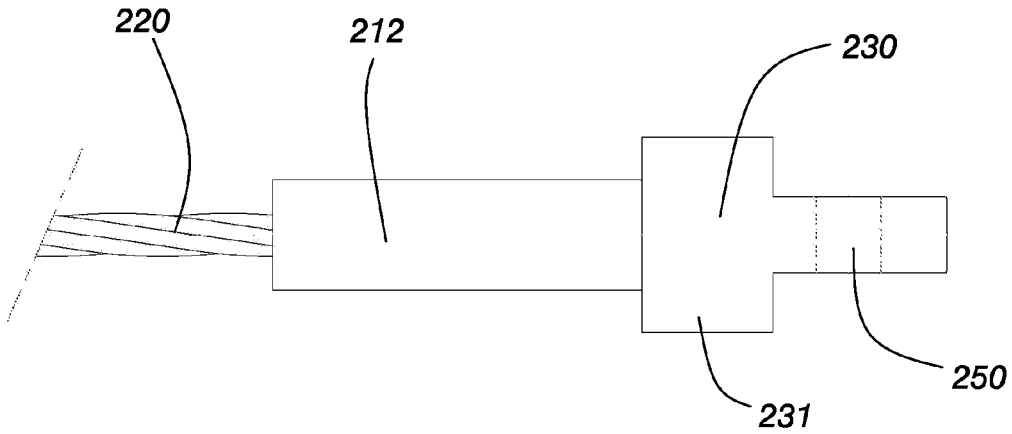
FIG. 15 is a side view of a centering collar element, centering housing element, concentric flange member, lifting eye member, and wire rope, according to the embodiment of FIG. 9.
Figure 16:
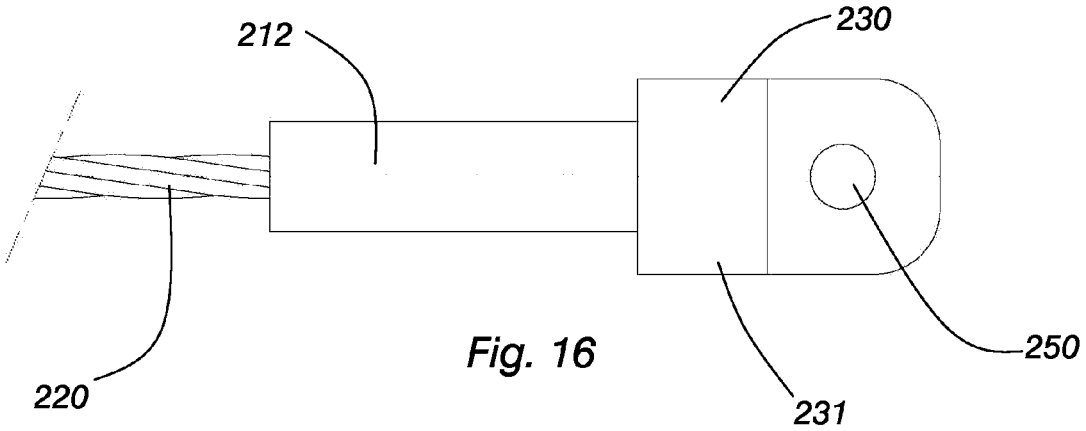
FIG. 16 is a front view of a centering collar element, centering housing element, concentric flange member, lifting eye member, and wire rope, according to the embodiment of FIG. 9.
Figure 17:
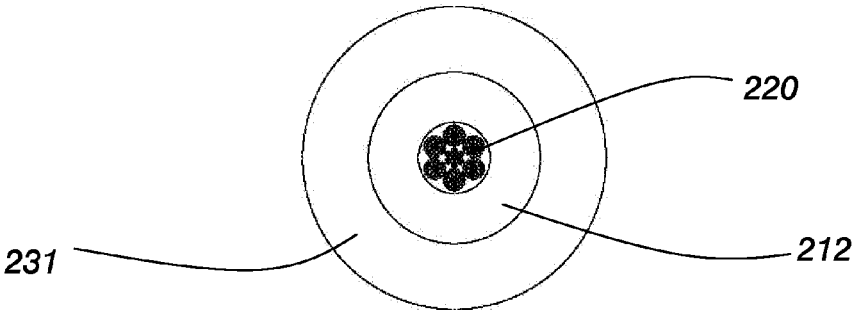
FIG. 17 is a partial cross-sectional bottom view of a centering collar element, centering housing element, concentric flange member, lifting eye member, and wire rope, according to the embodiment of FIG. 9.
Figure 18:
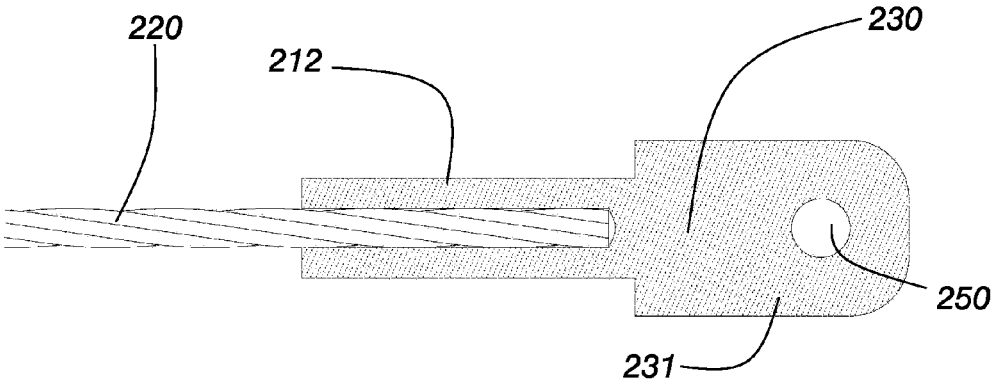
FIG. 18 is a cross-sectional front view of a centering collar element, centering housing element, concentric flange member, lifting eye member, and wire rope, according to the embodiment of FIG. 9.
Figure 19:
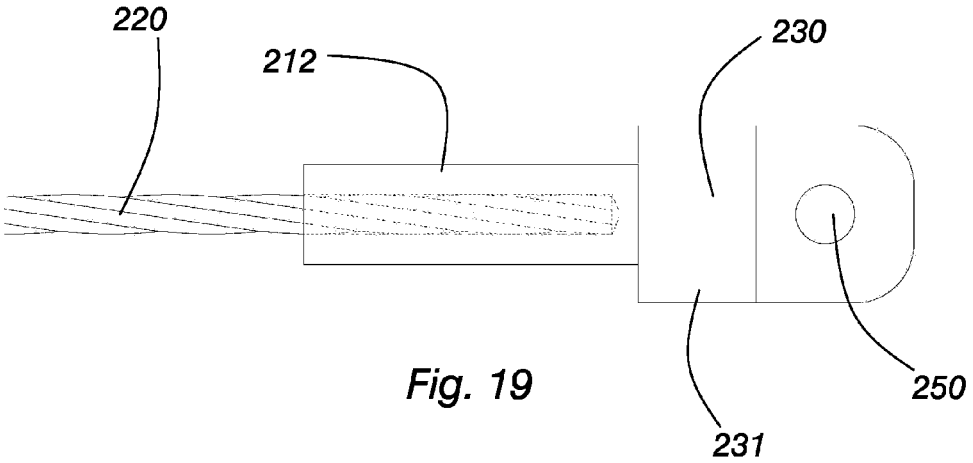
FIG. 19 is a partial cross-sectional front view of a centering collar element, centering housing element, concentric flange member, lifting eye member, and wire rope, according to the embodiment of FIG. 9.
Figure 20:
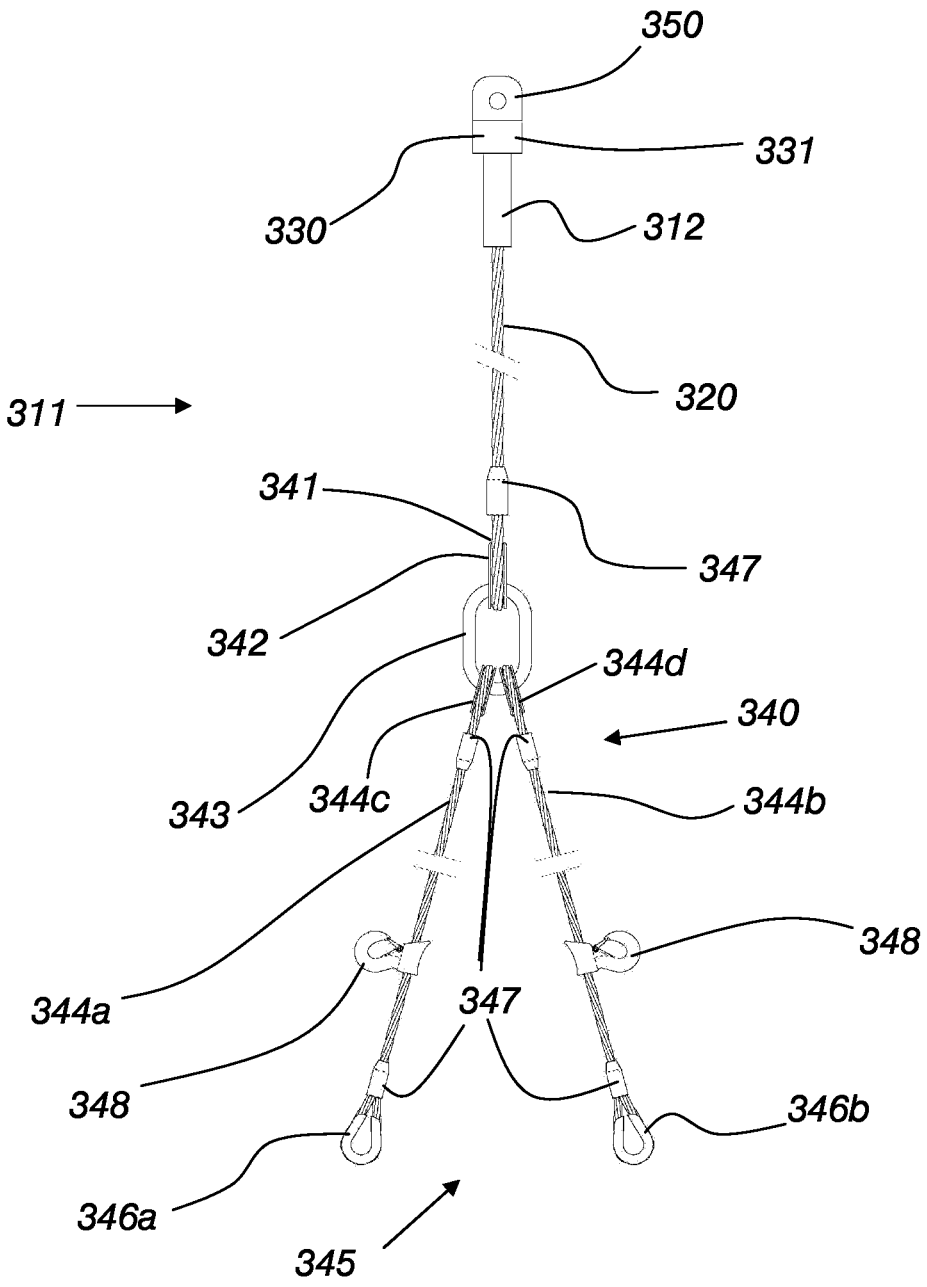
FIG. 20 is a front view of a lifting sling assembly according to a third alternate embodiment of the invention.

FIG. 8 shows a first alternate embodiment of the invention. According the embodiment, a lifting sling assembly 111, has a centering collar element 112, a wire rope 120, a centering housing element 130, a concentric flange member 131, and a lifting support 140. The lifting support means has a wire rope termination 141, a wire rope thimble eye 142, a D-Ring, two lifting wire rope legs 144*a*, 144*b*, wire rope leg thimble eyes 144*c*, 144*d*, a lifting termination 145, two lifting eyes 146*a*, 146*b*, one or more wire rope sleeves 147, and one or more sliding choker hooks 148, as shown in FIG. 8.

FIGS. 9-19 illustrate a second alternate embodiment of the invention. According the embodiment, a lifting sling assembly 211, has a centering collar element 212 with a central concavity 213, a wire rope 220, a centering housing element 230, a concentric flange member 231, a lifting support 240, and a lifting eye member 250. The lifting support means has a wire rope termination 241, a wire rope thimble eye 242, a D-Ring, two lifting wire rope legs 244*a*, 244*b*, wire rope leg thimble eyes 244*c*, 244*d*, a lifting termination 245, two lifting eyes 246*a*, 246*b*, and one or more wire rope sleeves 247, as shown in FIGS. 9-19. The two lifting wire rope legs 244*a*, 244*b*, are fabricated into a D-Ring 243, via the wire rope thimble eyes 244*c*, 244*d*. The centering housing element 230, concentric flange member 231, lifting support 240, and lifting eye member 250 are machined as one solid contiguous piece without the use of welding. The wire rope 220 is inserted into the centering collar element 212, and the centering collar element 212 is swaged onto the wire rope 220.

The wire rope 220 is inserted into the central concavity 213. The centering collar element 212 is swaged onto the wire rope 220. The swaging provides a permanent and continuous assembly of the wire rope 220, into the centering collar element 212. Accordingly, the wire rope 220, centering collar element 212, centering housing element 230, and concentric flange member 231 exist as one continuous element constructed of steel.

Figure 21:
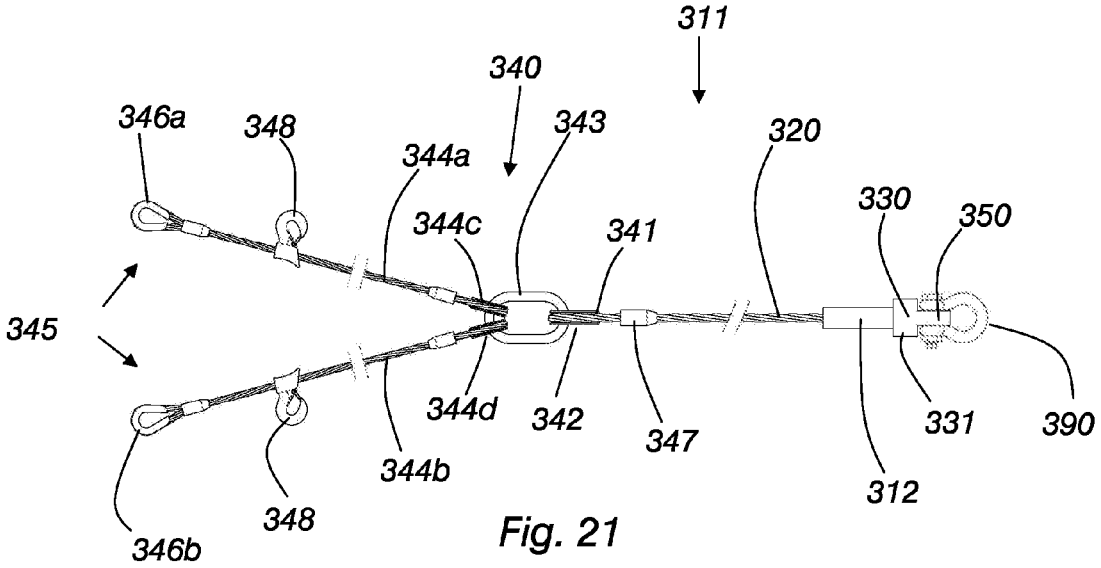
FIG. 21 is a front view of a lifting sling assembly with an attached sliding choker hook according to the embodiment of FIG. 20.
Figure 22:
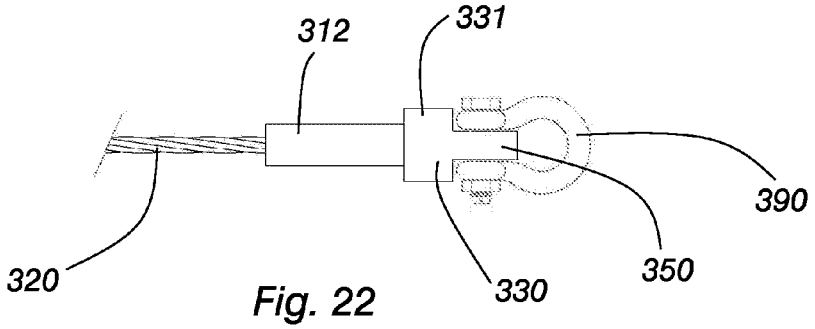
FIG. 22 is a front view of a centering collar element, centering housing element, concentric flange member, lifting eye member, and wire rope with an attached sliding choker hook according to the embodiment of FIG. 20.
Figure 23:
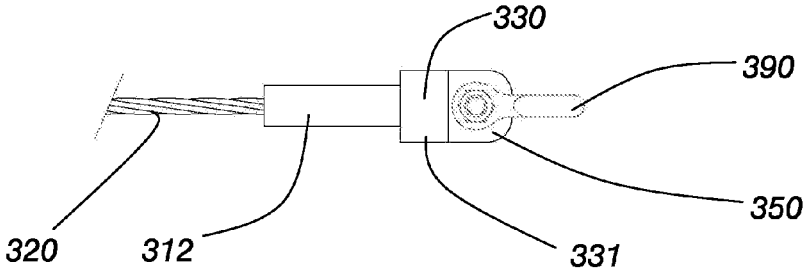
FIG. 23 is a side view of a centering collar element, centering housing element, concentric flange member, lifting eye member, and wire rope with an attached sliding choker hook according to the embodiment of FIG. 20.
Figure 24:
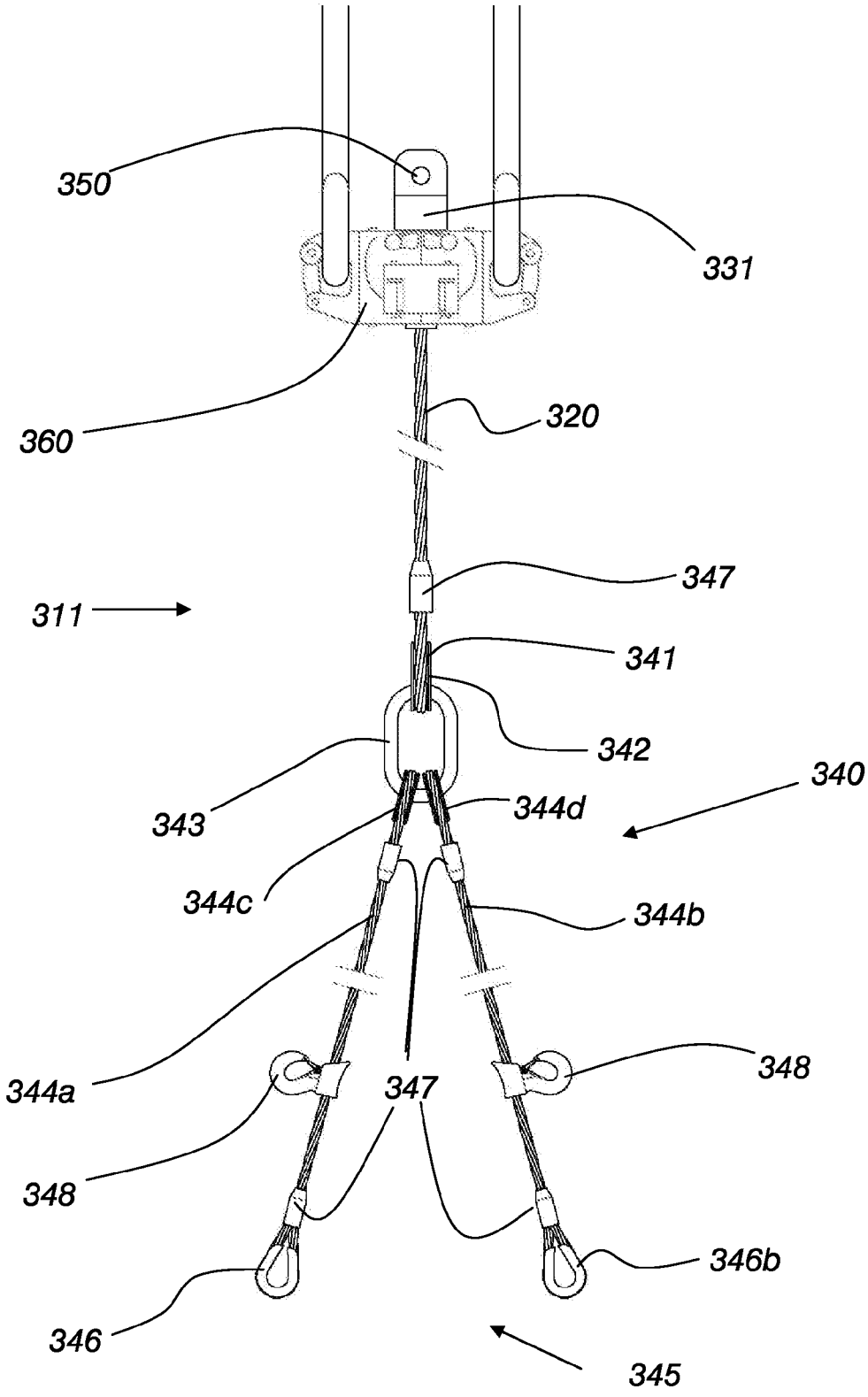
FIG. 24 is a front view of a lifting sling assembly attached to an elevator according to the embodiment of FIG. 20.
Figure 25:
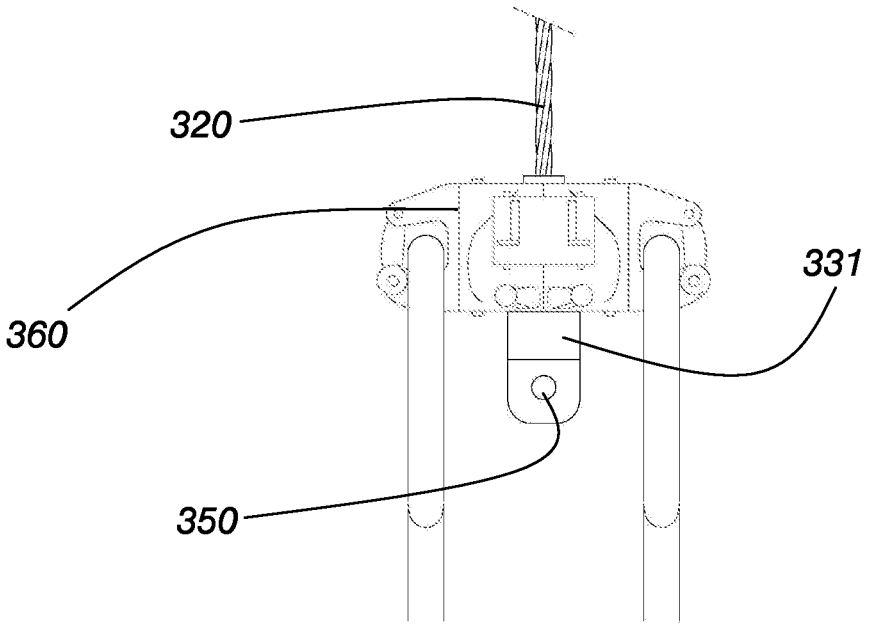
FIG. 25 is a front view of a centering collar element, centering housing element, concentric flange member, lifting eye member, and wire rope, attached to an elevator, according to the embodiment of FIG. 20.
Figure 26:
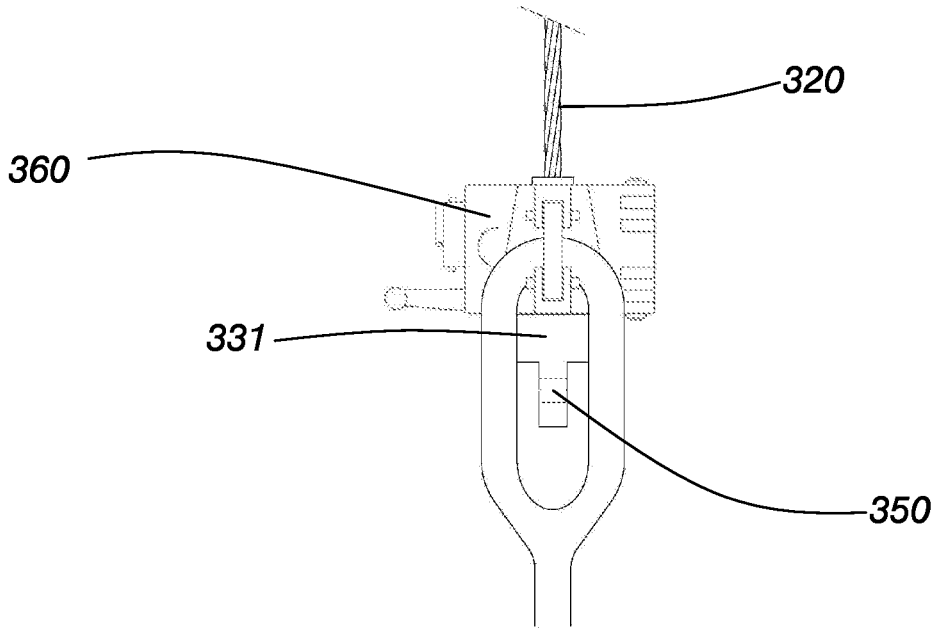
FIG. 26 is a side view of a centering collar element, centering housing element, concentric flange member, lifting eye member, and wire rope, attached to an elevator, according to the embodiment of FIG. 20.

FIGS. 20-26 illustrate a third alternate embodiment of the invention. According the embodiment, a lifting sling assembly 311, has a centering collar element 312, a wire rope 320, a centering housing element 330, a concentric flange member 331, a lifting support 340, and a lifting eye member 350. The lifting support means has a wire rope termination 341, a wire rope thimble eye 342, a D-Ring, two lifting wire rope legs 344*a*, 344*b*, wire rope leg thimble eyes 344*c*, 344*d*, a lifting termination 350, two lifting eyes 346*a*, 346*b*, and one or more wire rope sleeves 347, and one or more sliding choker hooks 348, as shown in FIGS. 20-26. The centering housing element 230, concentric flange member 231, lifting support 240, and lifting eye member 250 are machined as one solid contiguous piece without the use of welding. The wire rope 220 is inserted into the centering collar element 212, and the centering collar element 212 is swaged onto the wire rope 220. FIGS. 21-23 shown the lifting sling assembly 311 attached to a safety bolt shackle 390. FIGS. 24-27 show the lifting sling assembly 311 connected to an elevator 360.

Differing combinations and permutations of the embodiments set forth are contemplated by the current invention. Additionally, all functional equivalents of materials used and means of attachment of elements are contemplated by the current invention. Therefore, the spirit and scope of the appended claims should not be limited to the descriptions of the preferred versions and alternate embodiments set forth herein. Any element in a claim that does not explicitly state "means for" performing a specified function, or "step for" performing a specific function, is not to be interpreted as a "means" or "step" clause as specified in 35 U.S.C. §112, ¶6. In particular, the use of "step of" in the claims herein is not intended to invoke the provisions of 35 U.S.C. §112, ¶6.

What is claimed is:

1. A lifting sling assembly comprising: a centering collar element forming a concentric sleeve around a central concavity, wherein said central concavity extends from one outer side of said centering collar element, terminating a distance within said centering collar element; a centering housing element extending from said centering collar element; a concentric flange member forming a concentric sleeve around said centering housing element; wherein said concentric flange member further comprises a lower flange surface and a side flange surface; wherein said lower flange surface is substantially planar and extends perpendicular from said centering collar element, forming a rigid lifting body surface; wherein said centering collar element, said centering housing element, said lower flange surface, said side flange surface, and said concentric flange member are machined as one solid contiguous element of rigid material; a wire rope, wherein said wire rope is inserted into said central concavity disposed within said centering collar element, said centering collar element swaged onto said wire rope providing permanent and continuous assembly of said wire rope into said centering collar element; and a lifting support attached to said wire rope.

2. The lifting sling assembly of claim 1, wherein said central concavity of said centering housing element is dimensioned to accept a wire rope one inch (1") to two inches (2") in diameter.

3. The lifting sling assembly of claim 1, wherein said centering housing element is longitudinally extending rigid cylindrical member.

4. The lifting sling assembly of claim 1, further comprising a lifting eye member, wherein said centering collar element, said centering housing element, said concentric flange member, and said lifting eye member are machined as one solid contiguous element of rigid material.

5. The lifting sling assembly of claim 1, wherein said centering housing element has a diameter approximately the same as said centering collar element.

6. The lifting sling assembly of claim 1, wherein said concentric flange member is a concentric sleeve surrounding said centering housing element.

7. The lifting sling assembly of claim 6, wherein said concentric flange member has an outer diameter greater than an outer diameter of said centering housing element and an outer diameter of said centering collar element.

8. The lifting sling assembly of claim 6, wherein said concentric flange member has an outer diameter adapted to fit a 2⅜" elevator.

9. The lifting sling assembly of claim 6, wherein said concentric flange member has an outer diameter adapted to fit a 2⅞" elevator.

10. The lifting sling assembly of claim 1, wherein said wire rope diameter is between ½" to 1.5".

11. The lifting sling assembly of claim 1, wherein said lifting support is a mechanical support lifting apparatus.

12. The lifting sling assembly of claim 1, wherein said lifting support comprises a wire rope termination, two lifting rope legs, and a lifting termination.

13. The lifting sling assembly of claim 12, wherein said wire rope termination is a wire rope thimble eye with a D-Ring fabricated into said wire rope thimble eye.

14. The lifting sling assembly of claim 12, wherein said lifting termination implements two lifting eyes.

15. The lifting sling assembly of claim 12, wherein at least one wire rope sleeve is attached to said lifting support.

16. The lifting sling assembly of claim 1, wherein at least one sliding choker hook is attached to said lifting sling assembly.

17. The lifting sling assembly of claim 1, wherein said centering housing element is tapered.

18. The lifting system of claim 17, wherein at least one sliding choker hook is attached to said lifting sling assembly.

* * * * *